US006984141B1

(12) United States Patent
Beski, Sr. et al.

(10) Patent No.: US 6,984,141 B1
(45) Date of Patent: Jan. 10, 2006

(54) POWER SOCKET DEVICE WITH ENABLING SWITCH

(75) Inventors: Richard A. Beski, Sr., Branford, CT (US); Tony Jacques, Bristol, CT (US)

(73) Assignee: Casco Products Corporation, Shelton, CT (US)

( * ) Notice: Subject to any disclaimer, the term of this patent is extended or adjusted under 35 U.S.C. 154(b) by 0 days.

(21) Appl. No.: 11/070,435

(22) Filed: Mar. 2, 2005

(51) Int. Cl.
*H01R 29/00* (2006.01)

(52) U.S. Cl. ..... 439/188

(58) Field of Classification Search ..... 439/188, 439/552, 139, 143, 146, 346, 337, 259, 261; 200/43.01, 43.16, 50.1, 333, 51.09
See application file for complete search history.

(56) References Cited

U.S. PATENT DOCUMENTS 3,246,291 A * 4/1966 Lehner et al. ..... 367/188
3,781,495 A 12/1973 Splingaerd
5,347,095 A * 9/1994 Zeder ..... 200/51.09
5,374,199 A 12/1994 Chung
5,865,635 A 2/1999 Hsiang et al.
5,928,019 A * 7/1999 Chen et al. ..... 439/188
5,984,700 A * 11/1999 Chang ..... 439/139
6,111,210 A * 8/2000 Allison ..... 200/51.09
6,495,775 B2 12/2002 Lawson et al.
6,914,205 B2 * 7/2005 Galea ..... 200/43.01

* cited by examiner

*Primary Examiner*—J. F. Duverne
(74) *Attorney, Agent, or Firm*—Mitchell D. Bittman; Louis Dujmich

(57) ABSTRACT

A socket for providing electrical power, comprising a housing having an inner chamber, at least one electrically conductive terminal in said inner chamber, said at least one terminal being connectable to an electrical output of an electric power source, said at least one terminal being accessible through an opening in a wall of said housing to supply electrical power from said electric power source to an electrical connector being insertable through said opening, a socket enable switch operable to permit application of said electrical power to said at least one terminal, and said socket enable switch being electrically isolated from said electrical output of said electric power source; the socket enable switch comprising a plunger disposed to be moved by a portion of an electrical connector inserted through the opening, the plunger actuating the socket enable switch, the plunger being biased to return to a position to disable power to the socket when the connector is removed from the socket.

11 Claims, 7 Drawing Sheets

POWER SOCKET DEVICE WITH ENABLING SWITCH

BACKGROUND OF THE INVENTION

1. Field of the Invention

The present invention relates generally to a power socket with a switch for enabling power supply to the socket. More specifically, the present invention is related to a power socket that can be enabled using switches that are isolated from socket power, and actuated by some type of user intervention.

2. Description of the Related Prior Art

Power sockets that provide activation/de-activation switching of the power supplied to the socket are known in the art. For example, switched sockets are known that activate/de-activate a power socket based on safety criteria. U.S. Pat. No. 5,865,635 to Hsiang et al. is representative of this type of socket, in which power is supplied to the socket only upon insertion of a mating connector plug. The prongs of the mating connector plug activate contacts within the socket that provide power to the various legs of the plug prongs inserted into the power socket. Each prong of the inserted mating plug activates a contact which enables power to another prong of the mating connector socket. This arrangement provides a safety feature, whereby an object inserted into one of the socket receptacles will not cause that receptacle to be powered, thereby reducing the possibility of electric shock.

Other known socket configurations include that represented by U.S. Pat. No. 5,374,199 to Chung, in which a power socket is activated only upon activation of a plunger type mechanism, which closes contacts within a socket to provide power to the inserted prongs of the mating connector plug. This feature provides a safety and security feature, because the socket remains unpowered until an appropriately configured mating connector plug is inserted into the socket.

Similarly, U.S. Pat. No. 5,984,700 to Chang discloses a socket which remains unpowered until a mating connected plug is fully inserted and rotated 90 degrees. The mating connector plug only receives power once it has been inserted into the socket and rotated 90 degrees, upon which contacts within the socket are closed to provide power to the various socket terminals. In addition, once the mating connector plug is inserted and rotated 90 degrees in the socket, the mating connector plug is secured within the socket, thereby providing a feature which prevents the unintentional disconnection of the socket and plug once power is being supplied.

U.S. Pat. No. 3,781,495 to Splingaerd shows a socket provided with an access cover, which disconnects power to the socket once it is pivoted away from the socket receptacle. The pivoted socket cover interrupts power to at least one leg of the connector socket, which interrupts the power supply to the mating connector plug. In addition, since the socket cover prevents access to the socket unless it is pivoted open, the cover acts as a safety shut-off, useful for devices drawing power from the socket, in addition to preventing potential harm to an individual accessing the socket.

In all of the above disclosures, the actuating switches that provide power to the socket receptacles also carry socket power. That is, the switching elements are typically contacts which conduct power to a particular terminal of the socket once actuated. The devices of the prior art typically do not disable power to a socket completely, nor do they control switching of the power source that provides power to the socket. Moreover, the prior art does not show any way of determining whether the socket is powered based on simple visual observation.

The present invention overcomes the drawbacks of the prior art by providing a switched power socket in which the switching signal can be isolated from socket power. The present invention further provides an indication of whether the socket is powered. Furthermore, the present invention provides several safety features which help to ensure safe and proper operation of the socket.

An example of a power socket in which the enabling socket switch is electrically isolated from the output of the power source to the socket is shown in U.S. Pat. No. 6,495,775, assigned to the assignee of this application. The present invention is an improvement on the device of this latter patent.

SUMMARY OF THE INVENTION

Briefly stated, the electrical socket according to the invention provides power to a mating connector plug when actuated by a switch contained in the socket. The switch is actuated by user action, i.e., inserting a connector plug. The switch is isolated from the power supplied to the socket and acts as a power supply signal to enable socket power. The socket is powered only when needed, i.e., when the connector plug is inserted. The switch actuation method provides safety by disabling power to the socket unless the socket is actually in use. The socket cover and slide cover also prevent access to the socket unless positioned to receive a connector.

According to an embodiment of the present invention, there is provided a socket for providing electrical power, comprising: a housing having an inner chamber, at least one electrically conductive terminal in the inner chamber, the at least one terminal being connectable to an electrical output of an electric power source, the at least one terminal being accessible through an opening in a wall of the housing to supply electrical power from the power source to an electrical connector insertable through the opening, a socket enable switch operable to permit application of the electrical power to the at least one terminal and the socket enable switch being electrically isolated from the electrical output of the electric power source, the socket enable switch comprising a plunger disposed to be moved by a portion of a connector inserted through the opening, the plunger actuating the socket enable switch, the plunger being biased to return to a position to disable power to the socket when the connector is removed from the socket. Preferably, the plunger is moved by a prong of the inserted electrical connector. Further, preferably there are two conductive terminals and a plunger and switch associated with each terminal.

BRIEF DESCRIPTION OF THE DRAWINGS

The invention will now be described in greater detail in the following detailed description with reference to the drawings in which.

DETAILED DESCRIPTION OF THE PREFERRED EMBODIMENTS

Figure 1:
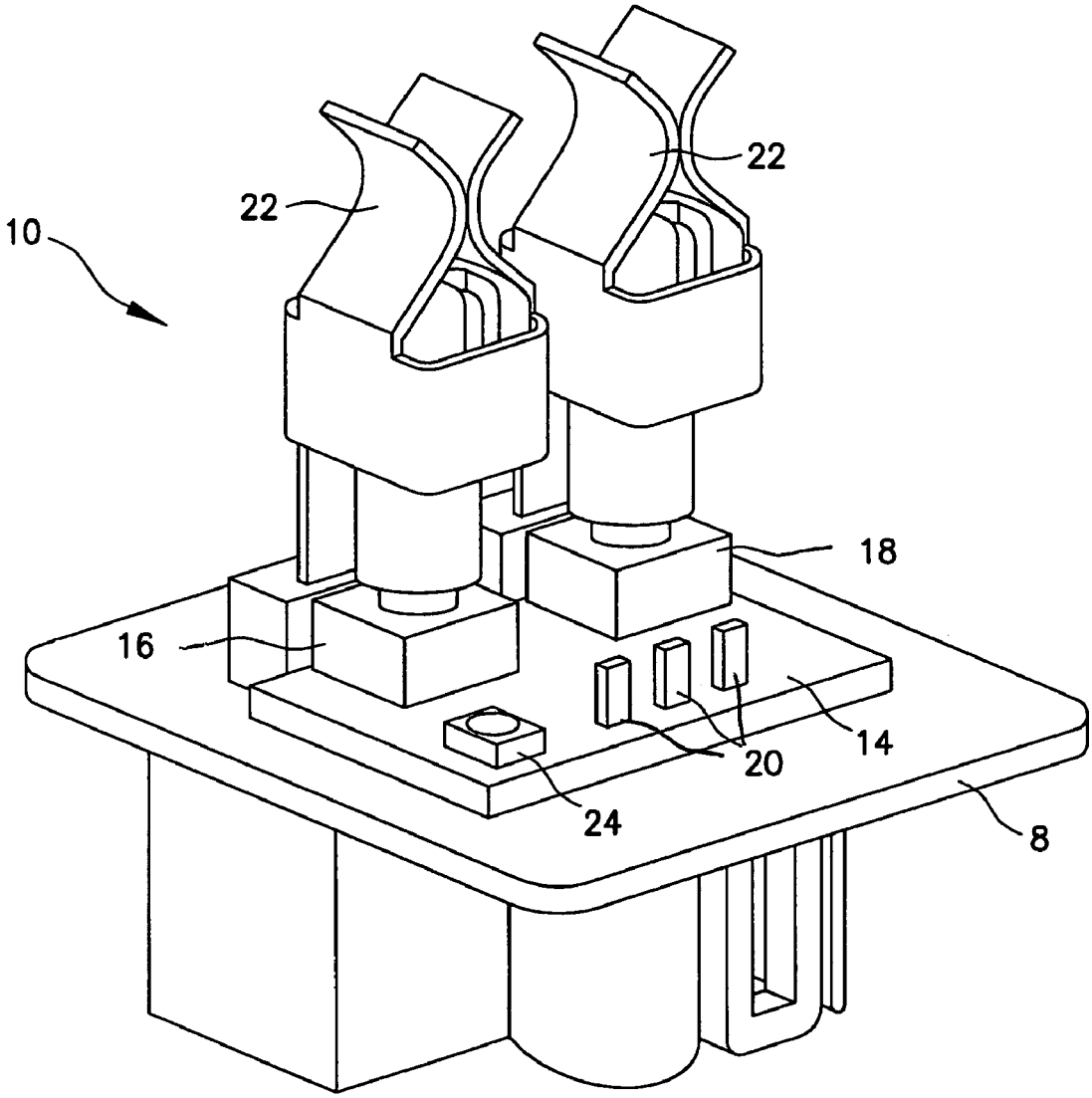
FIG. 1 shows a perspective view of the terminals and enabling switches of the power socket of the present invention with the casing removed.
Figure 2:
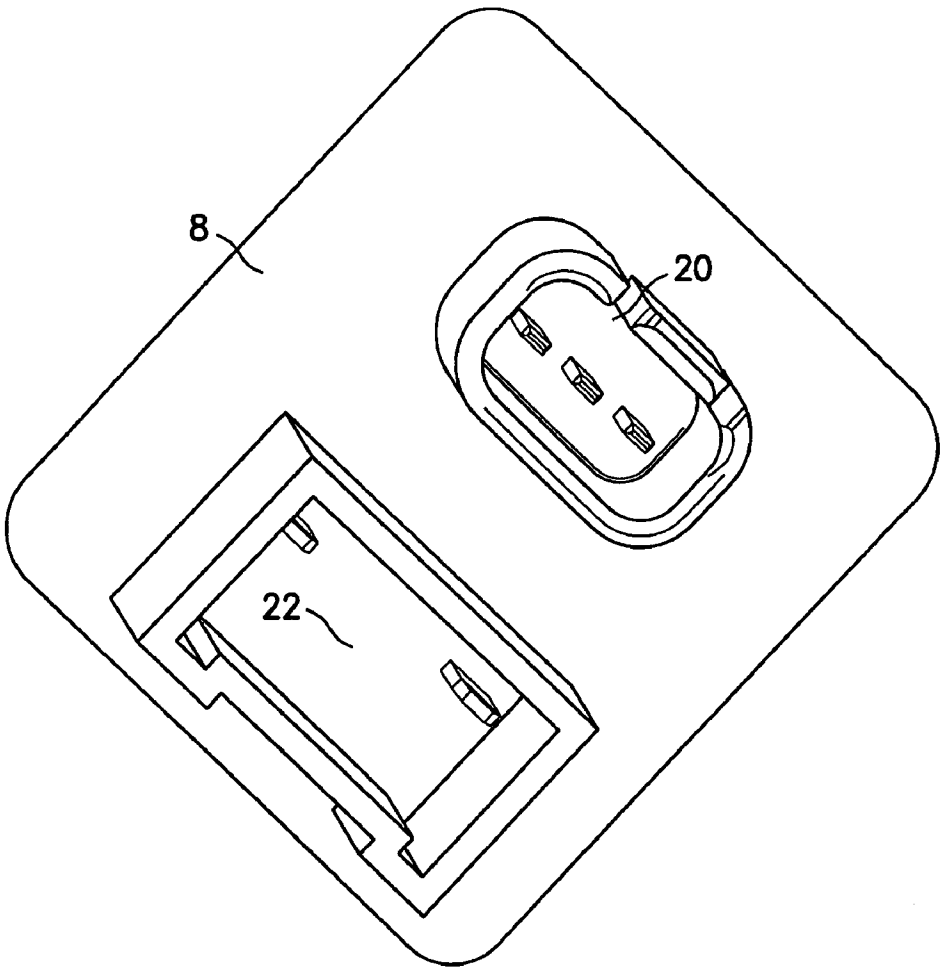
FIG. 2 shows a bottom perspective view of the power socket of FIG. 1.
Figure 5:
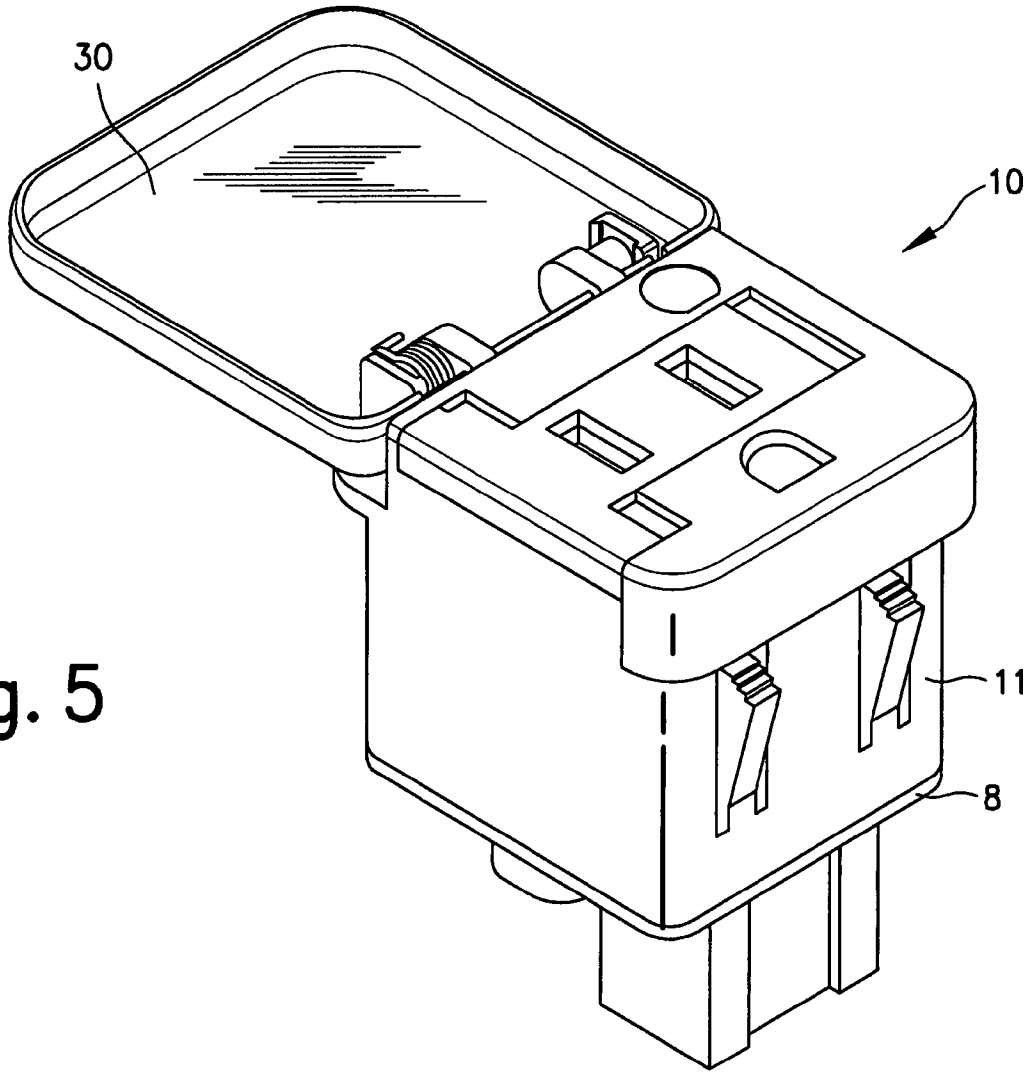
FIG. 5 is a top perspective view of the power socket showing the cover of the casing open 180°.

With reference now to the drawings, FIG. 1 shows the interior of the power socket according to the present invention. The external appearance, with the cover open, is shown in FIG. 5. The power socket 10 includes a base 8 on which is mounted a printed circuit board 14 which has mounted thereon two switches 16 and 18. The two switches 16 and 18 are connected to terminals 20 mounted on the printed circuit board. These are visible in the bottom view of FIG. 2. These terminals are typically low voltage terminals which control a control circuit once the switches are actuated to provide the higher voltage/current electrical power to the terminals 22, for example, to connect the AC hot and neutral power leads from, for example a DC-AC inverter, to the terminals 22. Accordingly, only when switches 16 and 18 are actuated can the AC power be connected to the terminals 22 for energization of a device connected to the terminals 22. In addition, an illumination source such as an LED 24 may be provided on the printed circuit board for illuminating a display portion of the socket when power is provided to terminal 22. The other ends of terminals 22 are shown in FIG. 2 in the bottom view and connect to a suitable AC connector. This connector would provide both the hot and neutral as well as the ground connection to the socket.

Although two enabling switches 16, 18 are shown, only one can be provided, mechanically actuated preferably by the hot connector of the device plugged into the socket.

Figure 3:
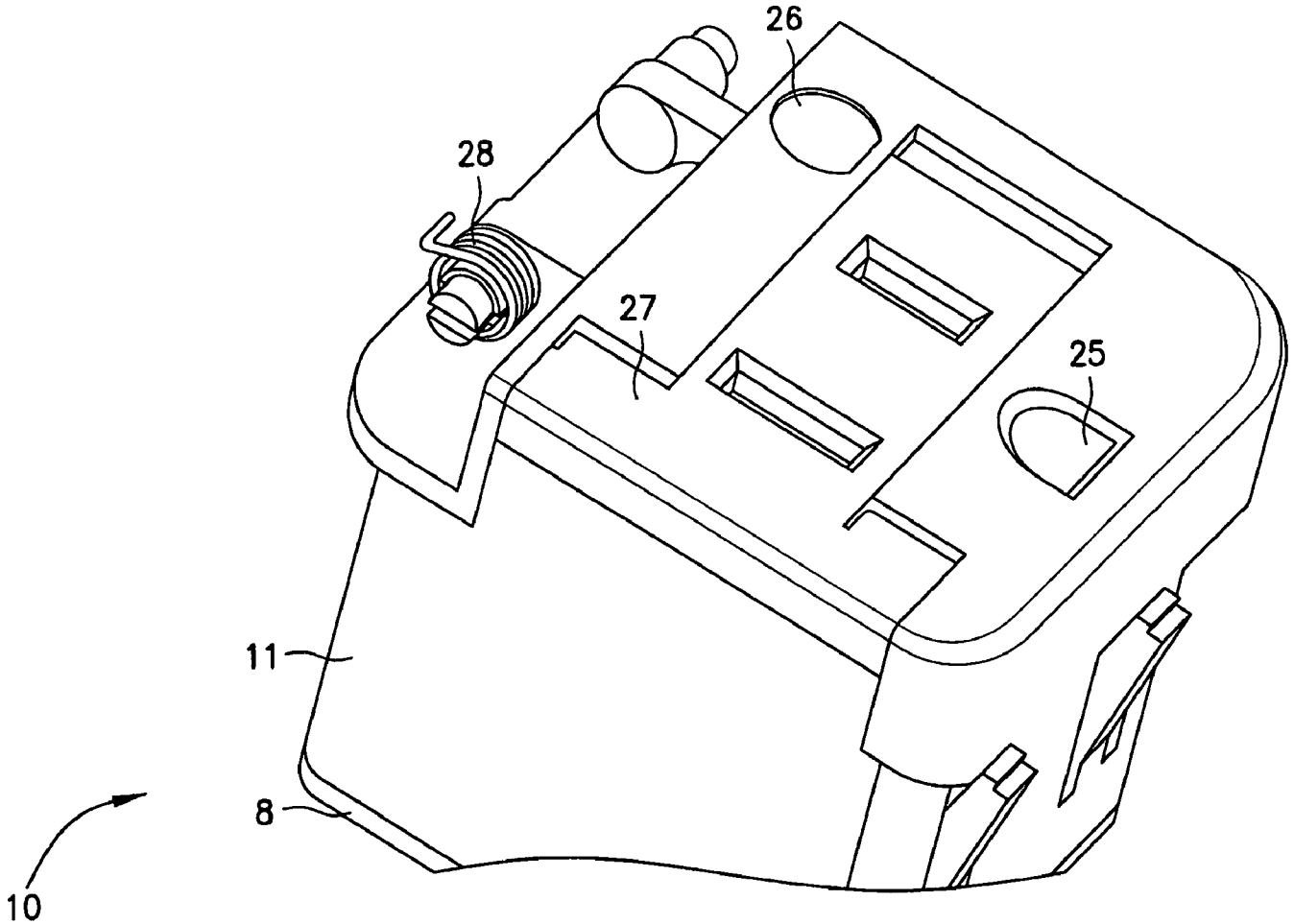
FIG. 3 shows a top perspective view of the power socket with the casing in place.

FIG. 3 shows a top view of the power socket with the casing in place, but with the hinged top cover removed.

Preferably the casing 11 comprises a housing on which is provided a safety slider 27. The casing 11 can be a snap-fit on base 8. The safety slider has openings which align with the openings in the casing to expose the terminals 22 when the safety slider is slid to one side. Otherwise, the terminals 22 are not exposed when the slider is in the safety position. The slider may be spring loaded so that it slides back to the safety position although it need not be and instead can have a lock or detent to lock or hold it in the safety position.

As shown, a ground opening 25 is provided for the ground connector of an electrical plug. A light pipe 26 s provided which the LED 24 illuminates when power is on. A torsion spring 28 may also be provided to allow the cover 30, as shown in FIG. 5, to spring back closed.

Figure 4:
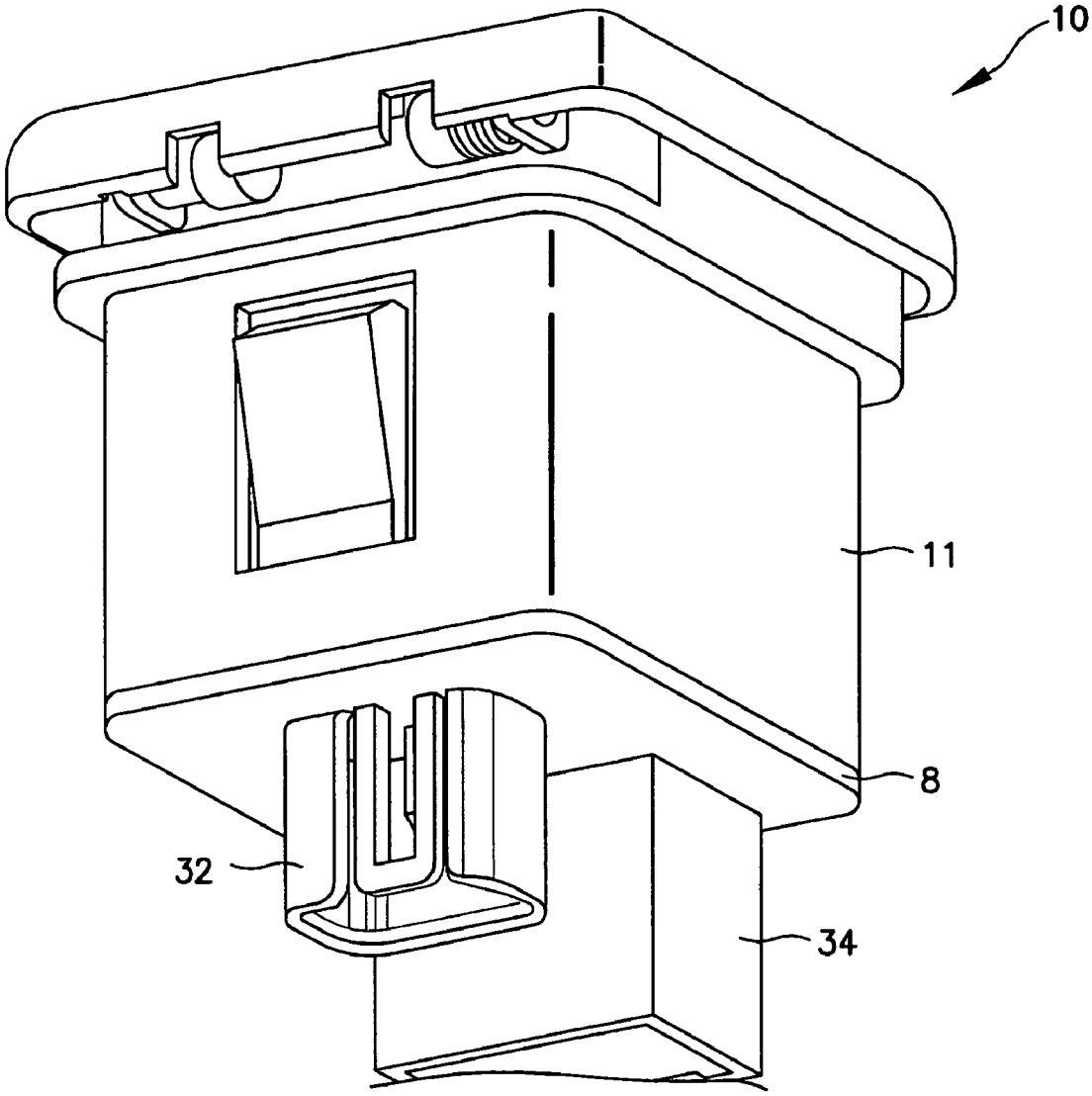
FIG. 4 is a side perspective view of the power socket with the casing in place.

FIG. 4 shows a bottom perspective view of the power socket with the cover closed. The sockets 32 and 34 for terminals 20 and 22, respectively, are also shown. Socket 32 is the low voltage connector coupled to the switches 16 and 18 and socket 34 is the AC connector.

Figure 7:
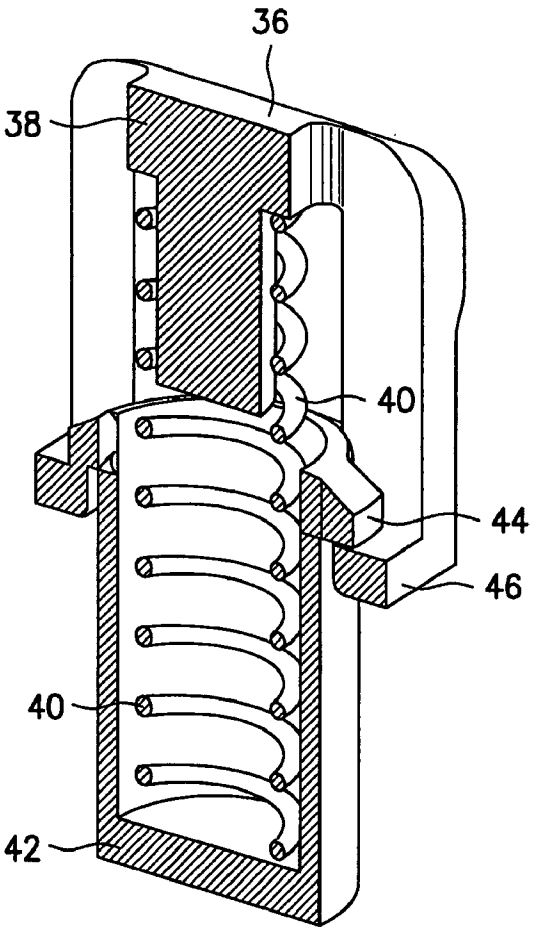
FIG. 7 is a cutaway view of the plunger of FIG. 6.
Figure 6:
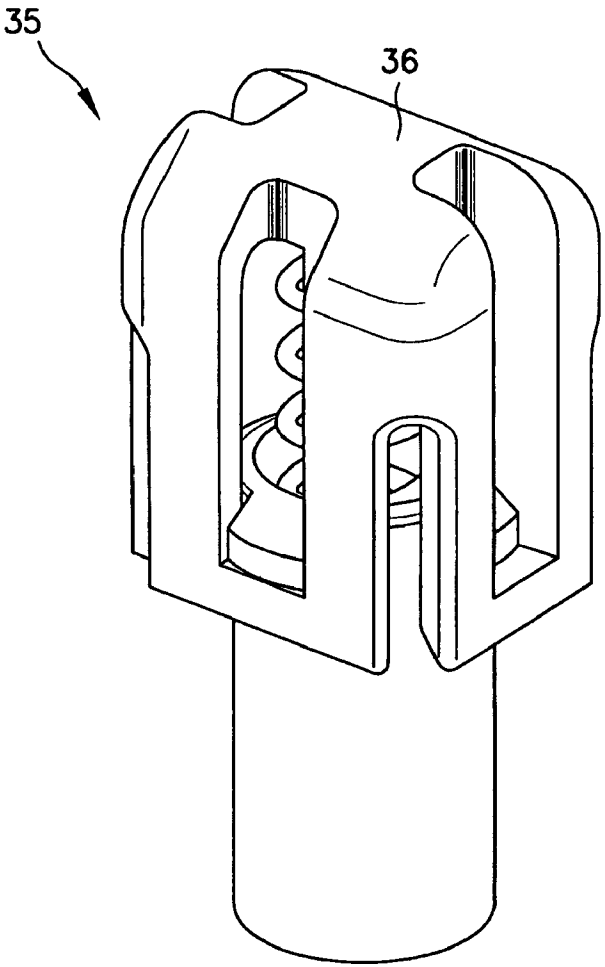
FIG. 6 shows one of the plungers which operate the enabling switches of the power socket.
Figure 9:
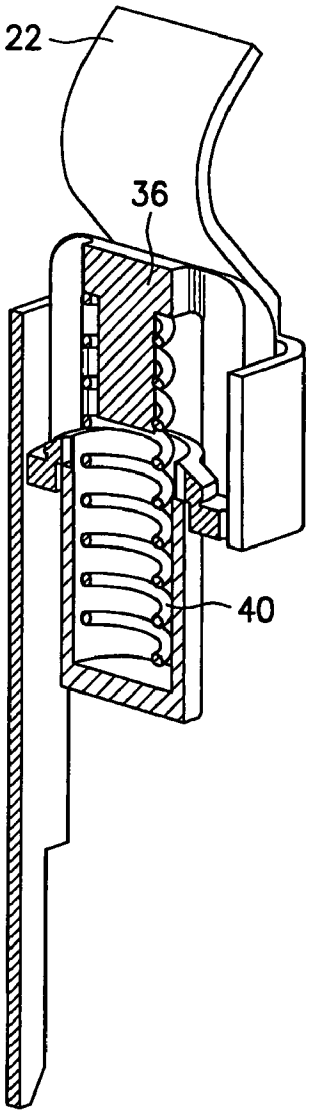
FIG. 9 is a cutaway view of the terminal and plunger.
Figure 8:
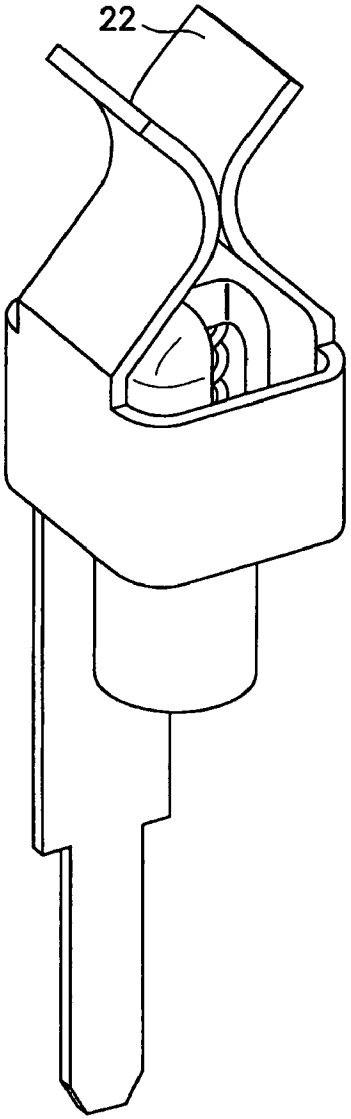
FIG. 8 shows one terminal of the power socket with the plunger in place.

FIGS. 6 and 7 show the plungers 35 which actuate the switches 16 and 18. The plungers 35 are located in the center of the terminals 22 shown in FIG. 1. Each plunger comprises an actuating member 36 including a top holder 38 which holds a compression spring 40 in place. The compression spring is located in a bottom can 42 which has a shoulder 44 resting on a shoulder 46 of the actuating member 36. Preferably plungers 35 are made of an insulating material such as plastic. Preferably plungers 35 are of integral construction, or made of a minimal number of pieces to allow insertion of spring 40. Spring 40, although shown as metal, may also be made of some other material providing a biasing force, and can be some other type spring, not necessarily a coil spring as shown. When the actuating member 36 is engaged by the spade prong of an electrical plug inserted into the openings in the socket, the actuating member 36 moves downwardly, applying pressure to compress the spring 40 which causes the bottom can 42 to move downwardly, thereby actuating respective switch 16 or 18. As shown in the drawings, each terminal 22 includes two opposed surfaces for electrically and frictionally engaging the prong of the electrical connector and the plunger associated with the terminal is preferably disposed in a centered orientation with respect to the terminal opposed surfaces so as to be actuated by the connector prong when the prong is inerted. See also FIGS. 8 and 9. As shown in FIG. 1, two plungers are preferably provided, each actuating a respective switch 16 and 18, although one could be used.

The power socket can be connected as shown in FIGS. 10A and 10B of U.S. Pat. No. 6,495,775, the entire disclosure of which is incorporated by reference herein. Preferably, to provide isolation, it is connected as shown in FIG. 10A of U.S. Pat. No. 6,495,775. Since two switches are provided in the embodiment described, the two switches can be connected in series so that power will be applied only if both switches are actuated. However, the switches can be connected in different ways. For example, only one of the switches need be used. As shown in FIGS. 1 and 2, three terminals 20 are provided connected to the switches so that one of the terminals may be common to both switches. Alternatively, four terminals can be provided, two for each switch. As shown in FIG. 10A of U.S. Pat. No. 6,495,775, when the switch(or switches) is closed, a relay coil is energized and the contacts of the relay complete a circuit to provide power to a DC to AC power inverter, which then provides AC power to the power socket 10. A relay need not be used, of course. Some other suitable switching device could be used, e.g., a semiconductor switch, etc. If the current is low, the switches 16 and 18 could also switch the input power to the inverter directly, although a relay or other controlled switching device is preferable.

The present invention may be embodied in other specific forms without departing from the spirit or essential attributes thereof and, accordingly, reference should be made to the appended claims, rather than to the foregoing specification, as indicating the scope of the invention.

What is claimed is:

1. A socket for providing electrical power, comprising:

a housing having an inner chamber;

at least one electrically conductive terminal in said inner chamber;

said at least one terminal being connectable to an electrical output of an electric power source;

said at least one terminal being accessible through an opening in a wall of said housing to supply electrical power from said electric power source to an electrical connector being insertable through said opening;

a socket enable switch operable to permit application of said electrical power to said at least one terminal; and said socket enable switch being electrically isolated from said electrical output of said electric power source; the socket enable switch comprising a plunger disposed to be moved by a portion of an electrical connector inserted through the opening, the plunger actuating the socket enable switch, the plunger being biased to return to a position to disable power to the socket when the connector is removed from the socket.

2. The socket of claim 1, wherein the plunger is moved by a prong of the inserted electrical connector.

3. The socket of claim 1, wherein there are two electrically conductive terminals and a plunger and switch associated with each terminal.

4. The socket of claim 1, wherein the electrically conductive terminal has two opposed surfaces for engaging the prong of the electrical connector and wherein the plunger is disposed in a centered orientation with respect to the opposed surfaces.

5. The socket of claim 1, further comprising an indicator for indicating when electrical power is provided to the socket.

6. The socket of claim 1, further comprising a cover for covering the opening when the socket is not in use.

7. The socket of claim 1, wherein the cover is pivotably mounted to the housing and biased to a closed position.

8. The socket of claim 1, further comprising a slide cover having an opening therein aligned with the opening in the wall of the housing when a user moves the slide cover to align the openings to allow insertion of said electrical connector.

9. The socket of claim 8, wherein the slide cover is biased to a position such that the opening in the slide cover and the opening in the wall of the housing are not aligned.

10. The socket of claim 1, wherein the plunger is spring biased.

11. The socket of claim 5, wherein the indicator comprises an LED.

* * * * *